US011488457B2

(12) United States Patent
Chakraborty et al.

(10) Patent No.: US 11,488,457 B2
(45) Date of Patent: Nov. 1, 2022

(54) CLOUD-CONNECTED OCCUPANCY LIGHTS AND STATUS INDICATION

(71) Applicant: Zurn Industries, LLC, Milwaukee, WI (US)

(72) Inventors: Arindam Chakraborty, Milwaukee, WI (US); Glen Trickle, Milwaukee, WI (US)

(73) Assignee: Zurn Industries, LLC, Milwaukee, WI (US)

( * ) Notice: Subject to any disclaimer, the term of this patent is extended or adjusted under 35 U.S.C. 154(b) by 0 days.

(21) Appl. No.: 17/094,583

(22) Filed: Nov. 10, 2020

(65) Prior Publication Data

US 2021/0383658 A1 Dec. 9, 2021

Related U.S. Application Data

(60) Provisional application No. 63/036,108, filed on Jun. 8, 2020.

(51) Int. Cl.
*E05B 65/06* (2006.01)
*G08B 5/36* (2006.01)

(52) U.S. Cl.
CPC ..... *G08B 5/36* (2013.01)

(58) Field of Classification Search
CPC ..... G08B 1/00; H04L 1/00
See application file for complete search history.

(56) References Cited

U.S. PATENT DOCUMENTS

| | | | |
|---|---|---|---|
| 4,563,780 | A | 1/1986 | Pollack |
| 4,805,247 | A | 2/1989 | Laverty, Jr. |
| 5,217,035 | A | 6/1993 | Van Marcke |
| 5,438,714 | A | 8/1995 | Shaw |
| 5,612,890 | A | 3/1997 | Strasser et al. |

(Continued)

FOREIGN PATENT DOCUMENTS

| | | | |
|---|---|---|---|
| CN | 101702035 | A | 5/2010 |
| CN | 112258542 | A | 1/2021 |

(Continued)

OTHER PUBLICATIONS

Tooshlights, Product Literature, website:https://tooshlights.com/products/, Copyright 2021, (11 Pages).

(Continued)

*Primary Examiner* — Hongmin Fan
(74) *Attorney, Agent, or Firm* — Michael Best & Friedrich LLP

(57) ABSTRACT

Methods and systems for providing an availability status associated with a facility. One system includes a visual indicator associated with a facility subsystem of the facility and a sensor configured to detect data associated with the facility subsystem. The system also includes a controller communicatively coupled to the visual indicator and the sensor. The controller is configured to receive a data from the sensor. The controller is also configured to determine a current availability status associated with the facility subsystem based on the data received from the sensor. The controller is also configured to control the visual indicator to indicate the current availability status associated with the facility subsystem.

12 Claims, 10 Drawing Sheets

(56) References Cited

U.S. PATENT DOCUMENTS

| | | | |
|---|---|---|---|
| 5,655,961 | A | 8/1997 | Acres et al. |
| 5,838,258 | A | 11/1998 | Saar |
| 5,844,808 | A | 12/1998 | Konsmo et al. |
| 6,018,827 | A | 2/2000 | Shaw et al. |
| 6,038,519 | A | 3/2000 | Gauthier et al. |
| 6,189,163 | B1 | 2/2001 | Van Marcke |
| 6,236,953 | B1 | 5/2001 | Segal |
| 6,337,635 | B1 | 1/2002 | Ericksen et al. |
| 6,347,414 | B2 | 2/2002 | Contadini et al. |
| 6,411,920 | B1 | 6/2002 | McConnell et al. |
| 6,583,720 | B1 | 6/2003 | Quigley |
| 6,642,843 | B2 | 11/2003 | Satoh |
| 6,694,177 | B2 | 2/2004 | Eggers et al. |
| 6,701,194 | B2 | 3/2004 | Gauthier et al. |
| 6,749,122 | B1 | 6/2004 | Koenck et al. |
| 6,766,221 | B1 | 7/2004 | Christiansen |
| 6,769,443 | B2 | 8/2004 | Bush |
| 6,956,498 | B1 | 10/2005 | Gauthier et al. |
| 6,967,565 | B2 | 11/2005 | Lingemann |
| 7,023,341 | B2 | 4/2006 | Stilp |
| 7,053,767 | B2 | 5/2006 | Petite et al. |
| 7,058,457 | B2 | 6/2006 | Kuwahara et al. |
| 7,119,658 | B2 | 10/2006 | Stilp |
| 7,143,007 | B2 | 11/2006 | Long et al. |
| 7,177,725 | B2 | 2/2007 | Nortier et al. |
| 7,222,111 | B1 | 5/2007 | Budike, Jr. |
| 7,226,496 | B2 | 6/2007 | Ehlers |
| 7,302,313 | B2 | 11/2007 | Sharp et al. |
| 7,304,569 | B2 | 12/2007 | Marcichow |
| 7,360,413 | B2 | 4/2008 | Jeffries et al. |
| 7,755,493 | B2 | 7/2010 | Berenguer et al. |
| 7,814,582 | B2 | 10/2010 | Reddy et al. |
| 8,028,355 | B2 | 10/2011 | Reeder et al. |
| 8,141,296 | B2 | 3/2012 | Bem |
| 8,284,018 | B2 | 10/2012 | Ibsies |
| 8,364,546 | B2 | 1/2013 | Yenni et al. |
| 8,407,821 | B2 | 4/2013 | Chan |
| 8,970,391 | B2 | 3/2015 | Hoekstra |
| 9,240,111 | B2 | 1/2016 | Scott et al. |
| 9,266,136 | B2 | 2/2016 | Klicpera |
| 9,429,453 | B1 | 8/2016 | O'Keeffe et al. |
| 9,574,374 | B2 | 2/2017 | Klevens et al. |
| 9,659,481 | B2 | 5/2017 | Himmelmann et al. |
| 9,830,565 | B2 | 11/2017 | O'Toole |
| 9,939,299 | B2 | 4/2018 | Patel et al. |
| 9,956,306 | B2 | 5/2018 | Brais et al. |
| 9,959,781 | B2 | 5/2018 | Roark |
| 9,963,863 | B2 | 5/2018 | Allard, III |
| 9,965,938 | B1 | 5/2018 | Cronin et al. |
| 10,066,379 | B2 | 9/2018 | Schomburg |
| 10,081,968 | B2 | 9/2018 | Klevens et al. |
| 10,264,588 | B2 | 4/2019 | Wegelin et al. |
| 10,276,018 | B2 | 4/2019 | Brillaud |
| 10,329,744 | B2 | 6/2019 | Abdel-Fattah et al. |
| 10,361,802 | B1 | 7/2019 | Hoffberg-Borghesani et al. |
| 10,430,737 | B2 | 10/2019 | Yenni et al. |
| 10,460,582 | B2 | 10/2019 | Anderholm et al. |
| 10,485,388 | B1 | 11/2019 | McIntosh |
| 10,504,070 | B2 | 12/2019 | Jacobson |
| 10,504,355 | B2 | 12/2019 | Wegelin et al. |
| 10,514,110 | B2 | 12/2019 | Allard, III |
| 10,527,191 | B2 | 1/2020 | Bush et al. |
| 10,529,167 | B2 | 1/2020 | Khamphilapanyo et al. |
| 10,529,219 | B2 | 1/2020 | Herdt et al. |
| 11,108,865 | B1 | 8/2021 | Chakraborty et al. |
| 11,307,570 | B2 | 4/2022 | Trinh et al. |
| 2002/0007510 | A1 | 1/2002 | Mann |
| 2002/0053969 | A1* | 5/2002 | Wagner ..... G08B 5/36 340/286.08 |
| 2002/0099454 | A1 | 7/2002 | Gerrity |
| 2006/0208862 | A1 | 9/2006 | Lahr et al. |
| 2009/0300988 | A1* | 12/2009 | Bem ..... E05B 47/02 49/340 |
| 2014/0249854 | A1 | 9/2014 | Moore et al. |
| 2014/0379305 | A1 | 12/2014 | Kumar |
| 2015/0233146 | A1 | 8/2015 | Klevens et al. |
| 2016/0258144 | A1 | 9/2016 | Tayenaka et al. |
| 2016/0345406 | A1 | 11/2016 | Donhowe et al. |
| 2017/0019970 | A1 | 1/2017 | Chemel et al. |
| 2017/0038224 | A1 | 2/2017 | O'Keeffe et al. |
| 2017/0122005 | A1 | 5/2017 | Klevens et al. |
| 2017/0129383 | A1 | 5/2017 | Buka et al. |
| 2017/0223807 | A1* | 8/2017 | Recker ..... H05B 47/19 |
| 2018/0198639 | A1 | 7/2018 | Ishizaka |
| 2018/0217292 | A1 | 8/2018 | Grosse-Puppendahl |
| 2018/0293877 | A1* | 10/2018 | Barth ..... G01F 23/0061 |
| 2018/0354777 | A1 | 12/2018 | Slater et al. |
| 2019/0001863 | A1 | 1/2019 | Taylor |
| 2019/0051214 | A1* | 2/2019 | Roark ..... G09B 21/007 |
| 2019/0351442 | A1 | 11/2019 | McNulty et al. |
| 2019/0353278 | A1 | 11/2019 | Bush et al. |
| 2019/0354535 | A1 | 11/2019 | Amin et al. |
| 2019/0359477 | A1 | 11/2019 | Wegelin et al. |
| 2019/0360184 | A1 | 11/2019 | Lawinger |
| 2019/0362617 | A1 | 11/2019 | Bonner et al. |
| 2019/0387058 | A1 | 12/2019 | Heller |
| 2019/0392377 | A1 | 12/2019 | Munir et al. |
| 2020/0011005 | A1 | 1/2020 | Okumura et al. |
| 2020/0032497 | A1 | 1/2020 | Wu |
| 2020/0097030 | A1 | 3/2020 | Carlson |
| 2020/0098199 | A1 | 3/2020 | Bullock |
| 2020/0099679 | A1 | 3/2020 | Carlson |
| 2020/0140254 | A1 | 5/2020 | Slater et al. |
| 2020/0141773 | A1 | 5/2020 | Burke et al. |
| 2020/0145257 | A1 | 5/2020 | Samudrala |
| 2020/0217057 | A1* | 7/2020 | Spiro ..... G08B 21/245 |
| 2020/0232832 | A1 | 7/2020 | Burke et al. |
| 2020/0253187 | A1 | 8/2020 | Flies et al. |
| 2020/0314866 | A1 | 10/2020 | Wegelin et al. |
| 2020/0358852 | A1 | 11/2020 | Burke et al. |
| 2020/0404357 | A1 | 12/2020 | Kulkarni et al. |
| 2021/0027402 | A1* | 1/2021 | Davis ..... G06Q 50/163 |
| 2021/0144210 | A1 | 5/2021 | Kohapure et al. |
| 2021/0358293 | A1 | 11/2021 | Tournier et al. |
| 2022/0020249 | A1 | 1/2022 | Castellano |
| 2022/0107632 | A1 | 4/2022 | Sinha et al. |

FOREIGN PATENT DOCUMENTS

| | | | |
|---|---|---|---|
| JP | H07311280 | A | 11/1995 |
| JP | 2002021149 | A | 1/2002 |
| JP | 2002148354 | A | 5/2002 |
| JP | 2004117250 | A | 4/2004 |
| JP | 2004258927 | A | 9/2004 |
| JP | 2010216821 | A | 9/2010 |
| JP | 2019083360 | A | 5/2019 |
| JP | 2020051757 | A | 4/2020 |
| KR | 101137918 | B1 | 4/2012 |
| TW | I727415 | B | 5/2021 |
| WO | WO1996041058 | A1 | 12/1996 |
| WO | WO2002056540 | A2 | 7/2002 |

OTHER PUBLICATIONS

Tooshlights, "Small upgrade. Big improvement, How it works", Copyright 2021 product brochure, (6 Pages).

Haitian, "Thingsee Presence" webpage: https://haltian.com/product/thingsee-presence/, publicly available at least as early as Nov. 10, 2020 (2 Pages).

Occupancy Lights, Social Distancing Technology, Powerpoint 1 Page, publicly available at least as early as Nov. 10, 2020.

Density, "Introducing Density Open Area" website: https://www.density.io/, dated Oct. 8, 2020 (7 Pages).

International Search Report with Written Opinion for related Application No. PCT/US2020/59873 dated Mar. 12, 2021 (14 Pages).

Acuitycontrols, "nLIGHT Network Lighting Control," Copyright 2014, (78 Pages).

Acuitycontrols, "SensorView Manual," Nov. 3, 2015, (123 Pages).

Chang et al., "Microprocessor Applications and Building Control Systems to Achieve Energy Conservation," U.S. Department of Commerce and National Bureau of Standards, Jul. 1980, (54 pages).

(56) References Cited

OTHER PUBLICATIONS

Garni, "Movement Direction and Distance Classification Using a Single PIR Sensor," in IEEE Sensors Letters, vol. 2, No. 1, Mar. 2018, pp. 1-4.
Ge, "Lightsweep Lighting Control System," Product Literature, Dec. 8, 2015, (12 Pages).
Jiang et al., "Residential House Occupancy Detection: Trust-Based Scheme Using Economic and Privacy-Aware Sensors," in IEEE Internet of Things Journal, vol. 9, No. 3, Feb. 1, 2022, pp. 1938-1950.
Johnson Controls, "Metasys® for Validated Environments (MVE)," Product Bulletin, Dec. 15, 2001, (13 pages).
Lighting Answers, "Controlling Lighting with Building Automation Systems," vol. 4, No. 1, May 1997, <https://www.lightingassociates.org/i/u/2127806/f/tech sheets/Lighting Control.pdf>, (8 pages).
Lutron, "Quantum Unlimited Capability for High-Performance Buildings," Product Literature, P/N 367-1321, Apr. 2018, (20 Pages).
Lutron, "What is Lighting Control System", Product Literature 366-396h, Publicly available prior to Nov. 19, 2020, (19 Pages).
Perra et al., "Monitoring Indoor People Presence in Buildings Using Low-Cost Infrared Sensor Array in Doorways", Sensors 2021,21,4062., Published Junel2, 2021 (19 Pages).
Shankar et al., "Human-tracking systems using pyroelectric infrared detectors", Optical Engineering 45(10), Oct. 2006, (10 Pages).
Trane, "Tracer™ SC System Controller for Tracer Building Automated Systems," Product Catalog, P/N BAS-PRC031-EH, Jun. 10, 2013, (27 Pages).
Wang et al., "A Lightweight People Counting Approachfor Smart Buildings," 2021 13th International Conference on Wireless Communications and Signal Processing (WCSP), pp. 1-5.
Wiatrowski, "Microprocessor Restroom Robot," Computer Design The Magazine of Digital Electronics, Apr. 1977, pp. 98-100, (3 pages).
Yang et al. "A novel low-cost and small-size human tracking system with pyroelectric infrared sensor mesh network," Infrared Physics & Technology, vol. 63, Mar. 2014, pp. 147-156,.
Yun et al., "Human Movement Detection and Identification Using Pyroelectric Infrared Sensors" Sensors 14, No. 5, website: https://doi.org/10.3390/s 140508057, Pubhshed May 4, 2014, pp. 8057-8081.

* cited by examiner

CLOUD-CONNECTED OCCUPANCY LIGHTS AND STATUS INDICATION

FIELD

Embodiments relate to monitoring and managing a facility having a plurality of end point devices, and, more particularly, to providing an availability status associated with the facility via a cloud-connected visual occupancy light or status indicator.

SUMMARY

In busy airports and commercial facilities, there is always huge amount of traffic going in and out of the public restrooms (or bathrooms). Without the presence of any kind of availability indicator or tracker, it is hard for customers to know which restrooms are available and which are not (for example, which restroom stall therein is available). With the presence of availability indicators (for example, a visual indicator light) a customer can easily identify available restroom stalls from a far distance. An availability indicator may visually display various colored lights as an indication of an availability status of a corresponding facility subsystem. As one example, the availability indicator may display a green light to indicate that the corresponding facility subsystem is available for use (as the availability status). As another example, the availability indicator may display a red light to indicate that the corresponding facility subsystem is unavailable for use (as the availability status). Accordingly, based on the availability status indicated via the availability indicator, a customer can easily direct herself/himself to an available facility subsystem, such as a vacant restroom stall.

Accordingly, embodiments described herein provide a system for determining an availability status associated with a facility (for example, a restroom, a building, or the like), such as a facility subsystem (for example, a restroom stall) including one or more end point devices (for example, a flush valve included in the restroom stall). Embodiments described herein may also display and/or communicate the availability status of facility subsystems therein using one or more availability indicators associated with the facility subsystems. In some embodiments, each facility, facility subsystem is associated with at least one availability indicator. As one example, a facility subsystem (including one or more end point devices) may be associated with an availability indicator, where the availability indicator indicates an availability status for the facility subsystem. According to this example, the availability indicator may be positioned at or near the facility subsystem, such as mounted to the ceiling above a restroom stall.

Determining and displaying the availability status of a facility subsystem provides a building owner, maintenance personnel, and users with insights into the utilization of the facility and/or facility subsystems therein. Accordingly, the embodiments described herein provides the building owner and users with insights into the occupancy levels, which enables the redirection of users to less utilized (or available/vacant) facilities or facility subsystems thereby reducing the costs associated with adding additional facilities (new construction or remodeling) and maintenance. By understanding the usage and usage patterns allows the maintenance personnel insights into how to optimize their cleaning and maintenance schedules thereby saving time, supplies, cleaning chemicals, water and costs. Additionally, displaying the availability status of a facility subsystem allows users to have an overall more pleasant experience due to shorter wait times and cleaner facilities.

Embodiments described herein provide for an enterprise-wide water management system for various facilities and/or facility subsystems (including fixtures and/or end point devices therein) connected to one or more networks. A facility subsystem may include a fixture, at least one end point device, and at least one availability indicator. The end point device may collect data associated with an operation of the fixture (for example, fixture data) and provide that data to the system. Alternatively or in addition, the availability indicator may collect data associated with an availability of the fixture and provide that data to the system. The data may be manipulated, analyzed, and displayed to a user of the system to provide intelligent information on usage, repair needs, preventative maintenance needs, and replenishment needs. As a result, the enterprise may develop efficiencies and receive data on how one or more facilities and/or facility subsystems are being used to better service and up-time for the fixtures.

For example, one embodiment provides a system for providing an availability status associated with a facility. The system includes a visual indicator associated with a facility subsystem of the facility and a sensor configured to detect data associated with the facility subsystem. The system also includes a controller communicatively coupled to the visual indicator and the sensor. The controller is configured to receive a data from the sensor. The controller is also configured to determine a current availability status associated with the facility subsystem based on the data received from the sensor. The controller is also configured to control the visual indicator to indicate the current availability status associated with the facility subsystem.

Another embodiment provides a method for providing an availability status associated with a facility. The method includes receiving data associated with a facility subsystem of the facility. The method also includes determining, with an electronic processor, a current availability status associated with the facility subsystem based on the data. The method also includes controlling, with the electronic processor, a visual indicator of the facility subsystem to indicate the current availability status associated with the facility subsystem.

Yet another embodiment provides an availability indicator for providing an availability status associated with a facility. The availability indicator includes a visual indicator associated with a facility subsystem of the facility. The availability indicator also includes a sensor configured to detect data associated with the facility subsystem. The availability indicator also includes a controller communicatively coupled to the visual indicator and the sensor. The controller is configured to receive a data from a sensor of the availability indicator. The controller is also configured to determine a current availability status associated with the facility subsystem based on the data received from the sensor. The controller is also configured to control the visual indicator to indicate the current availability status associated with the facility subsystem.

Other aspects and embodiments will become apparent by consideration of the detailed description and accompanying drawings.

DETAILED DESCRIPTION

Before any embodiments are explained in detail, it is to be understood the embodiments are not limited in their application to the details of construction and the arrangement of components set forth in the following description or illustrated in the following drawings. Other embodiments are possible and embodiments described and/or illustrated here are capable of being practiced or of being carried out in various ways.

It should also be noted that a plurality of hardware and software-based devices, as well as a plurality of different structural components may be used to implement the embodiments. In addition, embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (for example, stored on non-transitory computer-readable medium) executable by one or more processors. As such, it should be noted that a plurality of hardware and software-based devices, as well as a plurality of different structural components may be utilized to implement various embodiments. It should also be understood that although certain drawings illustrate hardware and software located within particular devices, these depictions are for illustrative purposes only. In some embodiments, the illustrated components may be combined or divided into separate software, firmware and/or hardware. For example, instead of being located within and performed by a single electronic processor, logic and processing may be distributed among multiple electronic processors. Regardless of how they are combined or divided, hardware and software components may be located on the same computing device or may be distributed among different computing devices connected by one or more networks or other suitable communication links.

Figure 1:
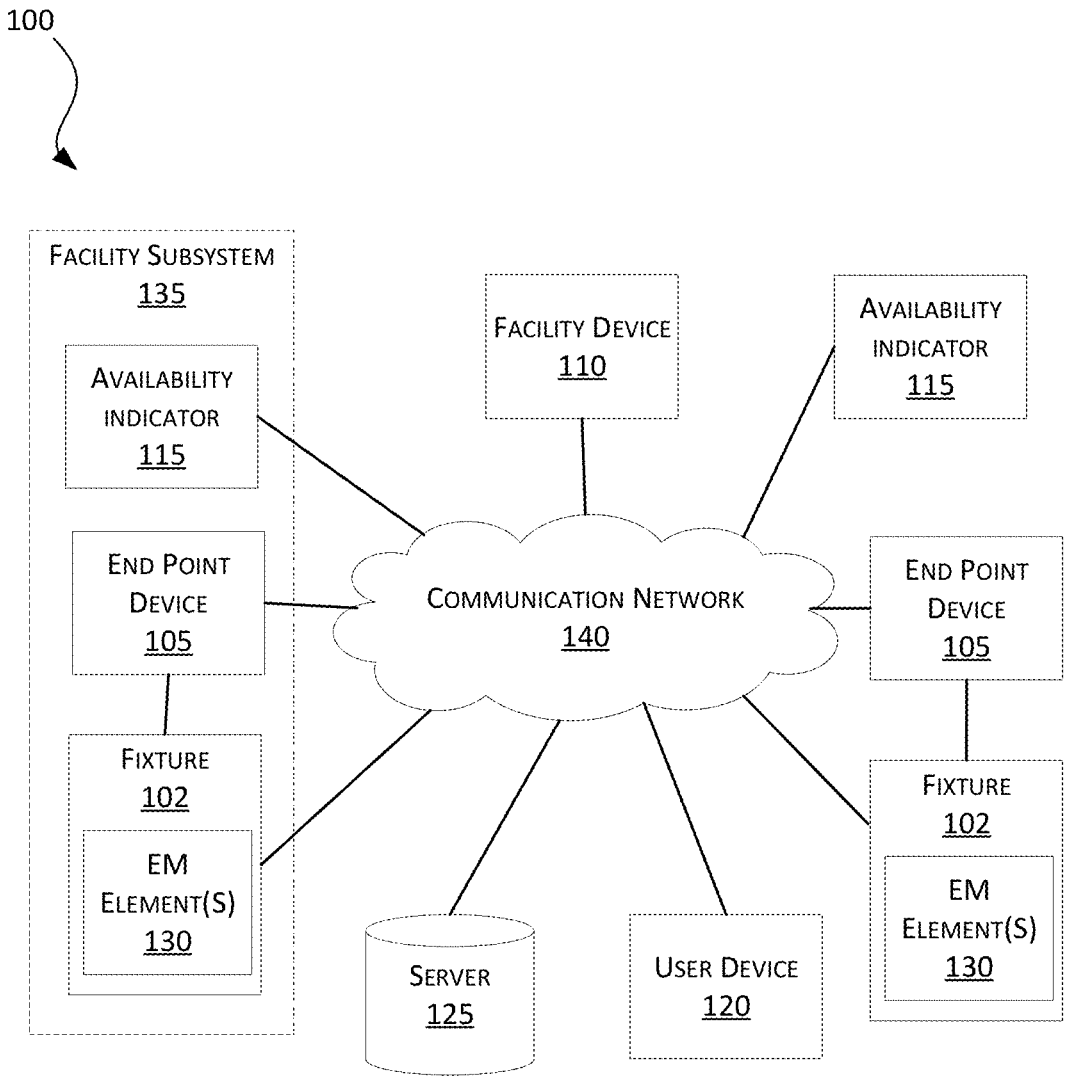
FIG. 1 schematically illustrates a system for providing an availability status associated with a facility according to some embodiments.

FIG. 1 illustrates a system 100 for providing an availability status associated with a facility according to some embodiments. In the illustrated example, the system 100 includes one or more fixtures 102 (collectively referred to herein as "the fixtures 102" and individually as "the fixture 102"), one or more end point devices 105 (collectively referred to herein as "the end point devices 105" and individually as "the end point device 105"), a facility device 110, one or more availability indicators 115 (collectively referred to herein as "the availability indicators 115" and individually as "the availability indicator 115"), a user device 120, and a server 125 (e.g., cloud-based server). In some embodiments, the system 100 includes fewer, additional, or different components than illustrated in FIG. 1 in various configurations. For example, the system 100 may include multiple facility devices 110, user devices 120, servers 125, or a combination thereof. Additionally, the system 100 may include any number of fixtures 102, end point devices 105, and/or availability indicators 115 and the two fixtures, endpoint devices, and availability indicators illustrated in FIG. 1 are purely for illustrative purposes.

As seen in FIG. 1, in some embodiments, one or more components of the system 100 may be included within a facility subsystem 135. In the illustrated example, the facility subsystem 135 includes the fixture 102, the end point device 105, and the availability indicator 115. In some embodiments, the facility subsystem 135 includes fewer, additional, or different components than illustrated in FIG. 1 in various configurations. For example, the facility subsystem 135 may include multiple fixtures 102, end point devices 105, availability indicators 115, or a combination thereof. As one example, the facility subsystem 135 may be a bathroom stall of a facility. According to this example, the bathroom stall (as the facility subsystem 135) may include a flush valve (as the fixture 102), an end point device 105 associated with the flush valve, and a corresponding availability indicator 115. As another example, the facility subsystem 135 may be a handwashing station of the facility (for example, a single handwashing station of a plurality of handwashing stations included in the facility). According to this example, the handwashing station (as the facility subsystem 135) may include a soap dispenser (as a first fixture 102) and a faucet (as a second fixture 102), a first end point device 105 associated with the soap dispenser, a second end point device 105 associated with the faucet, and a corresponding availability indicator 115. Accordingly, in some embodiments, a facility may include more than one facility subsystem 135.

A fixture 102 may include, for example, a faucet, a flushometer, a flush valve, a soap dispenser, a handwashing system, a water service line monitor, a backflow preventer, a floor drain, a hand dryer, a pressure sensor, a water use sensor, a flow sensor, a valve sensor, a lavatory, a toilet, a urinal, a water closet, a bottle and glass filler, a drain, a drinking water fountain, an air quality sensor, a backflow preventer, a leak detection sensor, an occupancy detection sensor, and a resource dispenser (for example, a soap dispenser, a sanitizer dispenser, a room deodorizer dispenser, a paper tower dispenser, and the like), and the like. Accordingly, in some embodiments, the fixture 102 is a water management solution. As seen in FIG. 1, each of the fixtures 102 includes one or more electro-mechanical ("EM") elements 130. The EM elements 130 are configured to monitor and/or influence the operation of the fixture 102. An EM element 130 may include, but is not limited to, an actuator, a flow sensor, a position sensor, a proximity sensor, a thermocouple, and the like.

As one example, in some embodiments, the fixture 102 is a faucet having a sensor (for example, as a first EM element 130) configured to detect the presence of a person. When the sensor is triggered (for example, by detecting the presence of a person), the sensor sends an "ON" signal to an actuator (as a second EM element 130) (for example, a valve actuating solenoid) thereby allowing water to selectively flow through the faucet. When the sensor is no longer triggered (for example, by detecting the absence of a person), the sensor sends an "OFF" signal to the actuator to stop water flow through the faucet. In some embodiments, the actuator is configured to maintain the faucet in an open position for a predetermined period of time in response to receiving an "ON" signal. In such embodiments, the predetermined period of time may be set by a user or facility entity via, for example, the facility device 110, the user device 120, another component of the system 100, or a combination thereof.

As another example, in some embodiments, the fixture 102 is a flush valve having a sensor (for example, as a first EM element 130) configured to detect the presence of a person. When the sensor is triggered (for example, by detecting the presence of a person), the sensor sends an "ON" signal to the actuator (as a second EM element 130) (for example, a valve actuating solenoid) to actuate a valve and initiate a flow of water for a flushing event. The flush valve will then remain open for a predetermined period of time (for example, 5 seconds, 10 seconds, and the like) at least partially dependent upon an operating parameter set by the user via, for example, the facility device 110, the user device 120, another component of the system 100, or a combination thereof.

As yet another example, in some embodiments, the fixture 102 is a resource dispenser (such as a soap dispenser, a hand towel dispenser, and the like) having a sensor (for example, as a first EM element 130) configured to detect the presence of a person. When the sensor is triggered (for example, by the hands of a person), the sensor sends an "ON" signal to an actuator (for example, as a second EM element 130) to trigger a resource dispensing event (for example, actuation of a valve to initiate dispensing of a resource). The resource dispenser is configured to allow a predetermined volume or amount of resource to be dispensed for each activation. In such embodiments, the volume or amount of resource to be dispensed may be set and adjusted by the user via, for example, the facility device 110, the user device 120, another component of the system 100, or a combination thereof.

The resource dispenser may also include a second sensor (for example, as a third EM element 130) to monitor the level or amount of resource remaining in a reservoir or receptacle. In some embodiments, the second sensor detects a current level or amount of resource in the reservoir or receptacle at a given moment in time. Alternatively or in addition, the second sensor may detect when the resource falls below a predetermined amount or level.

As yet another example, in some embodiments, the fixture 102 is a water service line monitor. The water service line monitor includes a sensor (for example, as a first EM element 130) configured to be retrofit onto an existing water service line and is configured to monitor the flow-rate of water therethrough, the presence of a backflow event, or a combination thereof. More specifically, the sensor may be configured to detect a flow rate, a presence of a backflow event, and the like.

As seen in FIG. 1, an end point device 105 generally includes a communication link with at least one fixture 102. The end point devices 105 may span multiple facilities, locations, rooms, and the like. In some embodiments, each of the end point devices 105 are associated with (located within) the same facility (for example, a restroom facility). However, in other embodiments, the end point devices 105 are associated with multiple facilities. As one example, a first end point device may be associated with a first facility, and a second end point device may be associated with a second different facility that is either in the same building as the first facility or in an entirely different building. Alternatively or in addition, in some embodiments, each of the end point devices 105 is associated with the same type of restroom fixture (for example, the fixture 102). However, in other embodiments, the end point devices 105 are associated with multiple different types of restroom fixtures (for example, the fixture 102). As one example, a first end point device may be associated with a faucet (as a first fixture 102) and a second end point device may be associated with a soap dispenser (as a second fixture 102).

Figure 2:
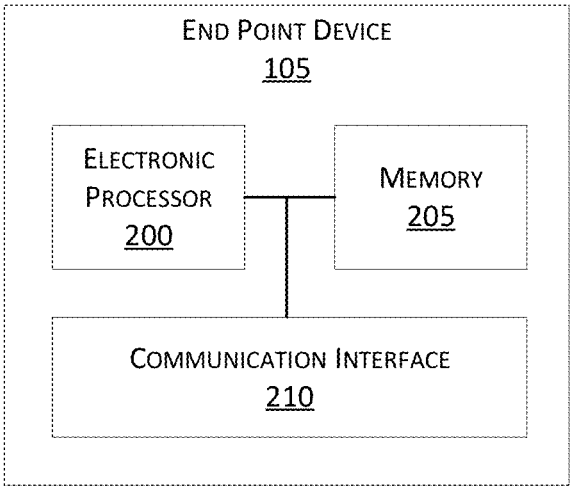
FIG. 2 schematically illustrates an end point device included in the system of FIG. 1 according to some embodiments.

FIG. 2 schematically illustrates the end point device 105 according to some embodiments. In the illustrated example, the end point device 105 includes an electronic processor 200, a memory 205, and a communication interface 210. The electronic processor 200, the memory 205, and the communication interface 210 communicate wirelessly, over one or more communication lines or buses, or a combination thereof. In some embodiments, one or more components of the end point device 105 may be distributed among multiple devices, integrated into a single device, or a combination thereof. In some embodiments, the end point device 105 may perform additional functionality other than the functionality described herein. In some embodiments, the end point device 105 may include additional, different, or fewer components than those illustrated in FIG. 2 in various configurations.

The communication interface 210 allows the end point device 105 to communicate with devices external to the end point device 105. For example, as illustrated in FIG. 1, the end point device 105 may communicate with the fixture 102 (or an EM element 130 thereof), the facility device 110, the availability indicator 115, the user device 120, the server 125 or a combination thereof through the communication interface 210. The communication interface 210 may include a port for receiving a wired connection to an external device (for example, a universal serial bus ("USB") cable and the like), a transceiver for establishing a wireless connection to an external device (for example, over one or more communication networks 140, such as the Internet, LAN, a WAN, such as a LoRa network or system, and the like), or a combination thereof. As one example, in some embodiments, the communication interface 210 includes a port for receiving a wired connection between the facility device 110 and an EM element 130 of a corresponding fixture 102. As another example, in some embodiments, the communication interface 210 includes a radio or transceiver for establishing a wireless connection, over a LoRa system or network, between the end point device 105 and the facility device 110.

Figure 3:
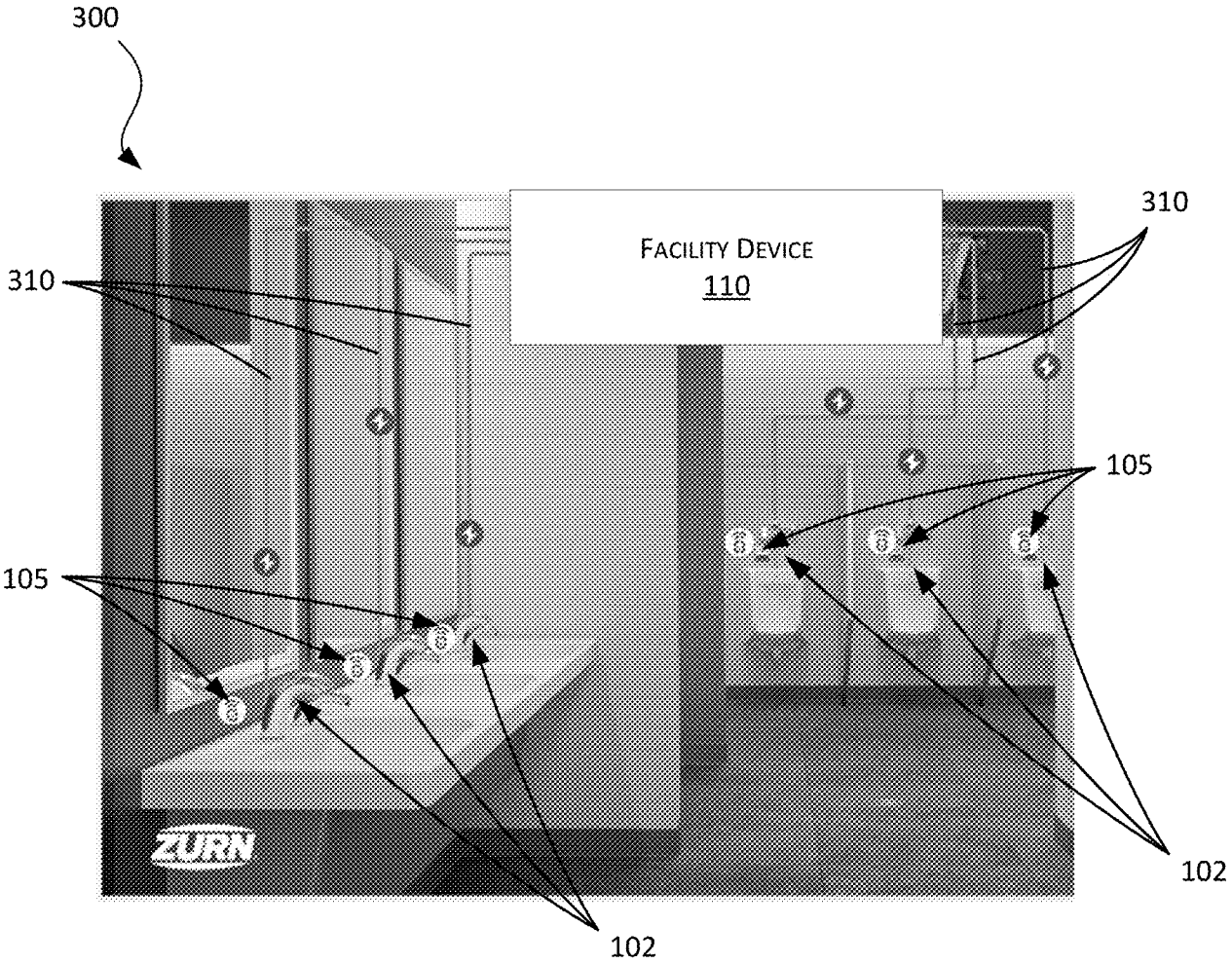
FIG. 3 illustrates an example facility including a plurality of end point devices and a facility device according to some embodiments.

The electronic processor 200 includes a microprocessor, an application-specific integrated circuit ("ASIC"), or another suitable electronic device for processing data, and the memory 205 includes a non-transitory, computer-readable storage medium. The electronic processor 200 is configured to access and execute computer-readable instructions ("software") stored in the memory 205. The software may include firmware, one or more applications, program data, filters, rules, one or more program modules, and other executable instructions. For example, the software may include instructions and associated data for performing a set of functions, including the methods described herein. For example, in some embodiments, the electronic processor 200 is configured to enable management and/or monitoring of the operation of the corresponding fixture 102 either directly or indirectly (for example, via the EM element(s) 130 of the corresponding fixture 102). In some embodiments, the electronic processor 200 enables management and/or monitoring of the operation of a corresponding fixture 102 by receiving fixture data from the fixtures 102, converting the fixture data for transmission, and enabling transmission of the converted data to, for example, the facility device 110, the user device 120, the server 125, another component of the system 100, or a combination thereof. Accordingly, in some embodiments, the electronic processor 200 is configured to interact with and collect data regarding an operation of a fixture 102 (as fixture data) via the EM elements 130 either directly or indirectly. For example, FIG. 3 illustrates an example facility 300 according to some embodiments. As seen in FIG. 3, the facility 300 includes a plurality of end point devices 105 associated with a plurality of corresponding fixtures 102. As seen in FIG. 3, the end point devices 105 communicate data (for example, fixture data) collected from the corresponding fixtures 102 to the facility device 110 (via, for example, one or more communication lines 310).

Figure 4:
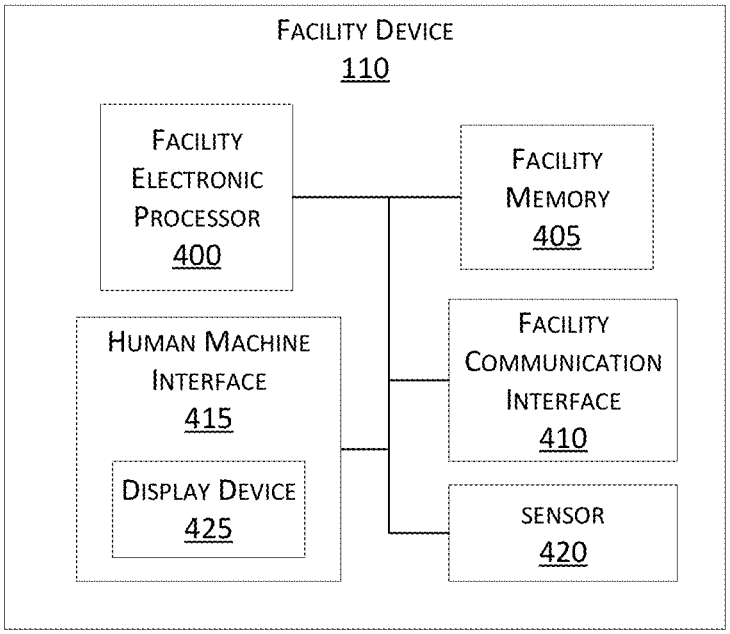
FIG. 4 schematically illustrates a facility device included in the system of FIG. 1 according to some embodiments.

FIG. 4 illustrates the facility device 110 according to some embodiments. In the illustrated example, the facility device 110 includes a facility electronic processor 400, a facility memory 405, a facility communication interface 410, a human machine interface 415, and a sensor 420. The facility electronic processor 400, the facility memory 405, the facility communication interface 410, the human machine interface 415, and the sensor 420 communicate wirelessly, over one or more communication lines or buses, or a combination thereof. The facility device 110 may include additional, different, or fewer components than those illustrated in FIG. 4 in various configurations. For example, in some embodiments, the facility device 110 includes multiple human machine interfaces 425, sensors 420, or a combination thereof. In some embodiments, one or more components of the facility device 110 may be distributed among multiple devices, integrated into a single device, or a combination thereof. In some embodiments, the facility device 110 may perform additional functionality other than the functionality described herein. Also, the functionality described herein as being performed by the facility device 110 may be distributed among multiple devices.

The facility communication interface 410 allows the facility device 110 to communicate with devices external to the facility device 110. For example, as illustrated in FIG. 1, the facility device 110 may communicate with the end point devices 105, the availability indicators 115, the user device 120, the server 125, or a combination thereof through the facility communication interface 410. The facility communication interface 410 may include a port for receiving a wired connection to an external device (for example, a USB cable and the like), a transceiver for establishing a wireless connection to an external device (for example, over one or more communication networks 140, such as the Internet, a LAN, a WAN, such as a LoRa system, and the like), or a combination thereof.

The facility electronic processor 400 (for example, a microprocessor, an ASIC, or another suitable electronic device for processing data) is configured to access and execute computer-readable instructions ("software") stored in the facility memory 405 (for example, a non-transitory, computer-readable storage medium). The software may include firmware, one or more applications, program data, filters, rules, one or more program modules, and other executable instructions. For example, the software may include instructions and associated data for performing a set of functions, including the methods described herein.

For example, in some embodiments, the facility electronic processor 400 executes instructions to determine a facility status, an occupancy level, or a combination thereof. An occupancy level generally indicates a number of occupants (people) within a facility at a given point in time. A facility status generally indicates an availability or accessibility associated with a facility. For example, a facility status may include an available status, an unavailable status, or the like. In some embodiments, the facility electronic processor 400 determines a facility status for a facility as a whole (for example, whether a facility is available or accessible for use). As one example, the facility status may include an unavailable status when none of the bathroom stalls are available (for example, all of the bathroom stalls are in use), when none of the faucets are available, or the like. As another example, the facility status may include an available status when one or more bathroom stalls are available for use, when one or more faucets are available for use, or the like. As described in greater detail below, the facility electronic processor 400 may access and process data received from one or more of the end point devices 105, the sensor 420, or a combination thereof to determine the facility status, the occupancy level, or a combination thereof. Accordingly, the facility status, the occupancy level, or a combination thereof may be based on data associated with one or more end point devices 105, the sensor 420, another component of the system 100, or a combination thereof.

The facility device 110 also includes the human machine interface 415 for interacting with a user. The human machine interface 415 may include one or more input devices, one or more output devices, or a combination thereof. Accordingly, in some embodiments, the human machine interface 415 allows a user to interact with (for example, provide input to and receive output from) the facility device 110. For example, the human machine interface 415 may include a touch screen, a mechanical button, a display device (for example, a liquid crystal display ("LCD")), a printer, a speaker, a microphone, another input/output device, or a combination thereof. As illustrated in FIG. 4, in some embodiments, the human machine interface 415 includes a display device 425. The display device 425 may be included in the same housing as the facility device 110 or may communicate with the facility device 110 over one or more wired or wireless connections. For example, in some embodiments, the display device 425 is a monitor, a television, or a projector positioned at or near an entry to a facility. In some embodiments, the display device 425 displays information, such as an occupancy level, a facility status, directions to an alternate facility, end point device 105, or facility subsystem, other facility related information, or a combination thereof.

Figure 5:
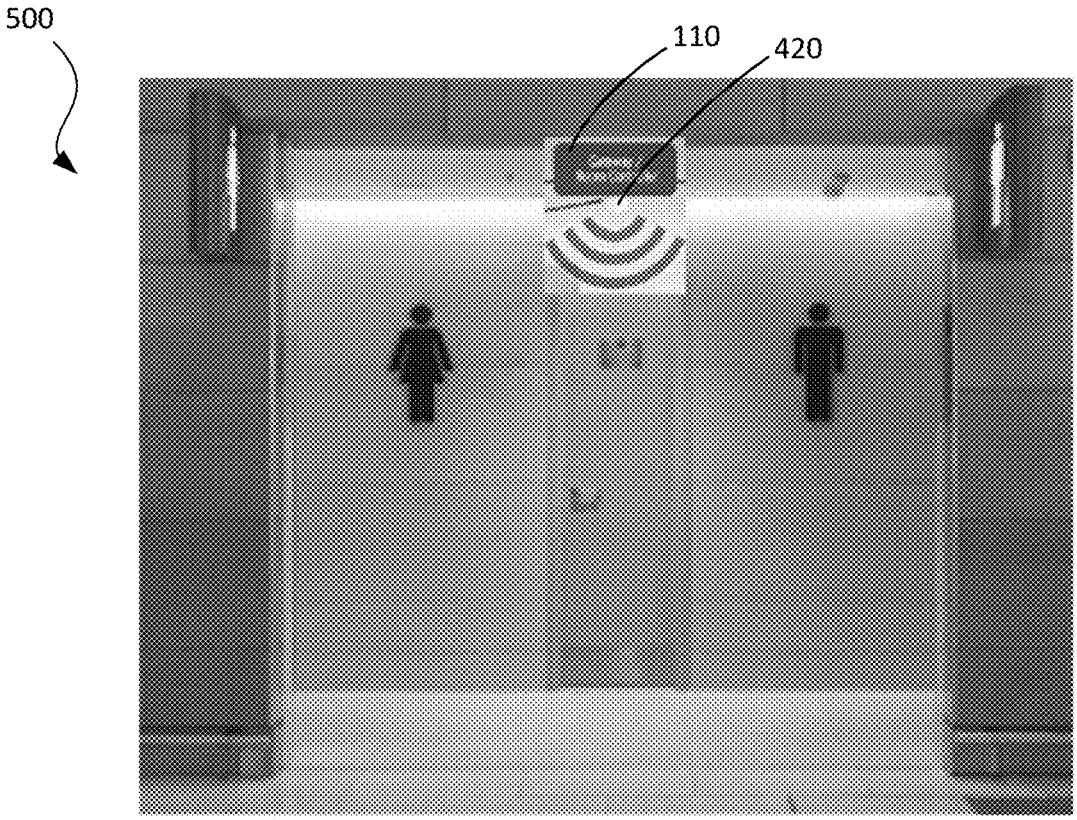
FIG. 5 illustrates a facility entrance including the facility device of FIG. 4 according to some embodiments.

In some embodiments, the facility device 110 also includes the sensor 420, as seen in FIG. 4. The sensor 420 is configured to detect an entry of a user or customer to a facility. As seen in FIG. 5, the sensor 420 may be mounted at an entry point of the facility 500, such as at a door of the facility 500 or a facility entrance. The sensor 420 may include, for example, a passive infrared ("PIR") sensor. In some embodiments, the sensor 420 is positioned at a beam angle that consistently detects entry of users such that an occupancy count or level of users entering the facility 500 at any point in time may be detected.

In some embodiments, the facility device 110 serves as a gateway or intermediary device that collects data from the electronic processors 200 of one or more of the end point devices 105 (as fixture data), data from one or more of the availability indicators 115 (as availability data), or a combination thereof. The facility device 110 may then process and forward the collected data (for example, the fixture data, the availability data, or a combination thereof), the data collected by the sensor 320, or a combination thereof to another component for processing. For example, in some embodiments, the facility device 110 forwards the data to a remote server for virtual processing (for example, the server 125). In some embodiments, the functionality (or a portion thereof) described as being performed by the facility device 110 may be performed by another remote device or server (not shown).

Returning to FIG. 1, the system 100 also includes the availability indicators 115. The availability indicator 115 is configured to determine and indicate an availability status associated with a facility. In some embodiments, the availability indicator 115 is associated with a facility subsystem (for example, the facility subsystem 135 of FIG. 1). In such embodiments, the availability indicator 115 is configured to indicate an availability status for the facility subsystem 135. As one example, the availability indicator 115 may indicate an availability status associated with a restroom stall (as the facility subsystem 135). Alternatively or in addition, the availability indicator 115 is associated with a facility. In such embodiments, the availability indicator 115 is configured to indicate an availability status for the facility as a whole.

Figure 6:
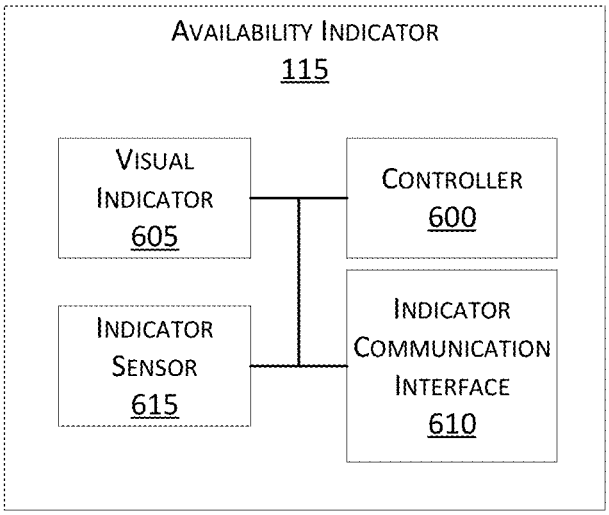
FIG. 6 schematically illustrates an availability indicator included in the system of FIG. 1 according to some embodiments.

As seen in FIG. 6, the availability indicator 115 may include a controller 600, a visual indicator 605, an indicator communication interface 610, and an indicator sensor 615. The availability indicator 115 may include additional, different, or fewer components than those illustrated in FIG. 6 in various configurations. For example, in some embodiments, the availability indicator 115 includes multiple controllers 600, visual indicators 605, indicator communication interfaces 610, indicator sensors 615, or a combination thereof. In some embodiments, one or more components of the availability indicator 115 may be distributed among multiple devices, integrated into a single device, or a combination thereof. In some embodiments, the availability indicator 115 may perform additional functionality other than the functionality described herein. Also, the functionality described herein as being performed by the availability indicator 115 (or a portion thereof) may be distributed among multiple devices.

Although not illustrated in FIG. 6, the controller 600 may include similar components as the end point device 105 as illustrated in FIG. 2, such as electronic processor (for example, a microprocessor, an ASIC, or another suitable electronic device), a memory (for example, a non-transitory, computer-readable storage medium), a communication interface, such as a transceiver, for communicating over the communication network 140 and, optionally, one or more additional communication networks or connections.

The indicator communication interface 610 allows the availability indicator 115 to communicate with devices external to the availability indicator 115. For example, as illustrated in FIG. 1, the availability indicator 115 may communicate with the end point devices 105, the facility device 110, the user device 120, the server 125, or a combination thereof through the indicator communication interface 610. The indicator communication interface 610 may include a port for receiving a wired connection to an external device (for example, a USB cable and the like), a transceiver for establishing a wireless connection to an external device (for example, over one or more communication networks 140, such as the Internet, a LAN, a WAN, such as a LoRa system, and the like), or a combination thereof.

In some embodiments, the controller 600 (via an electronic processor executing instructions stored in memory) determines an availability status for a corresponding facility subsystem 135 based on data collected by the indicator sensor 615. The indicator sensor 615 detects a presence of a user and/or use by a user associated with a facility (or a facility subsystem thereof). The indicator sensor 615 may include, for example, a PIR sensor, a thermal sensor, or the like. As one example, when indicator sensor 615 detects the presence of a user within a restroom stall (as the facility subsystem 135), the controller 600 may determine the availability status for the restroom stall as unavailable. As an example, if the indicator sensor 615 is a thermal sensor, the heat naturally emitted by the presence of a person is detected by the sensor. Accordingly, in some embodiments, the controller 600 is configured to receive data from the indicator sensor 615 and determine an availability status based on the data received from the indicator sensor 615.

Alternatively or in addition, in some embodiments, the controller 600 determines an availability status based on data received (via indicator communication interface 610) from one or more end point devices 105 (for example, an end point device 105 included in the facility subsystem 135). In some embodiments, the data received from the end point device 105 may be an error signal indicating a malfunction or error of a fixture 105 associated with the end point device. As one example, when a flush valve (as the fixture 102) experiences a run-on condition, the controller 600 may receive an error signal and determine that the availability status for the facility subsystem 105 associated with the flush valve is unavailable due to the run-on condition. Accordingly, in some embodiments, the controller 600 is configured to receive (via the indicator communication interface 610) data from the end point device 105 (as fixture data or an error signal) and determine an availability status based on the data received from the end point device 105.

Alternatively or in addition, in some embodiments, the controller 600 determines an availability status based on a control signal or a manually set availability status provided by a user (for example, via the user device 120, the facility device 110, or another component of the system 100). As one example, when the facility subsystem 135 is due for maintenance, a user may manually set or assign the availability for the facility subsystem 135 to unavailable. According to this example, the controller 600 may receive the assigned availability status (as unavailable) for the facility subsystem 135 and determine the availability status for the facility subsystem 135 as unavailable. Accordingly, in some embodiments, the controller 600 is configured to receive (via the indicator communication interface 610) control signals or data from a remote device (such as the user device 120, the facility device 110, another component of the system 100, or a combination thereof) and determine an availability status based on the control signals or data received from the remote device.

The controller 600 is also configured to generate and transmit one or more control signals to the visual indicator 605 based on the determined availability status. The visual indicator 605 indicates the availability status. In some embodiments, the visual indicator 605 is a light (such as an LED light or the like). The visual indicator 605 may indicate the availability status by visually displaying (or illuminating) various colored lights as an indication of an availability status. As one example, the visual indicator 605 may display a red light to indicate the availability status of "available." As another example, the visual indicator 605 may display a green light to indicate the availability status of "unavailable."

Figure 7:
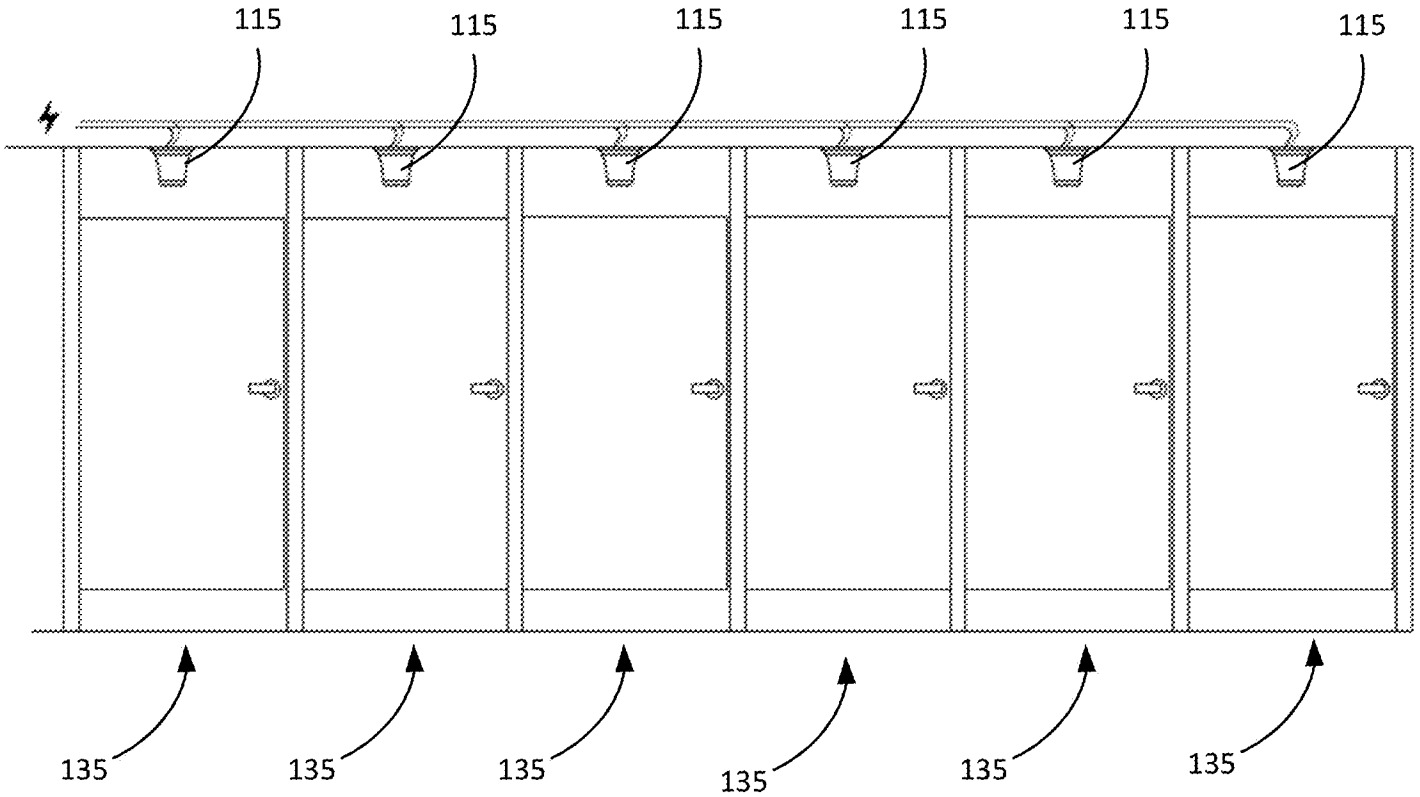
FIG. 7 illustrates availability indicators positioned within a facility according to some embodiments.
Figure 8:
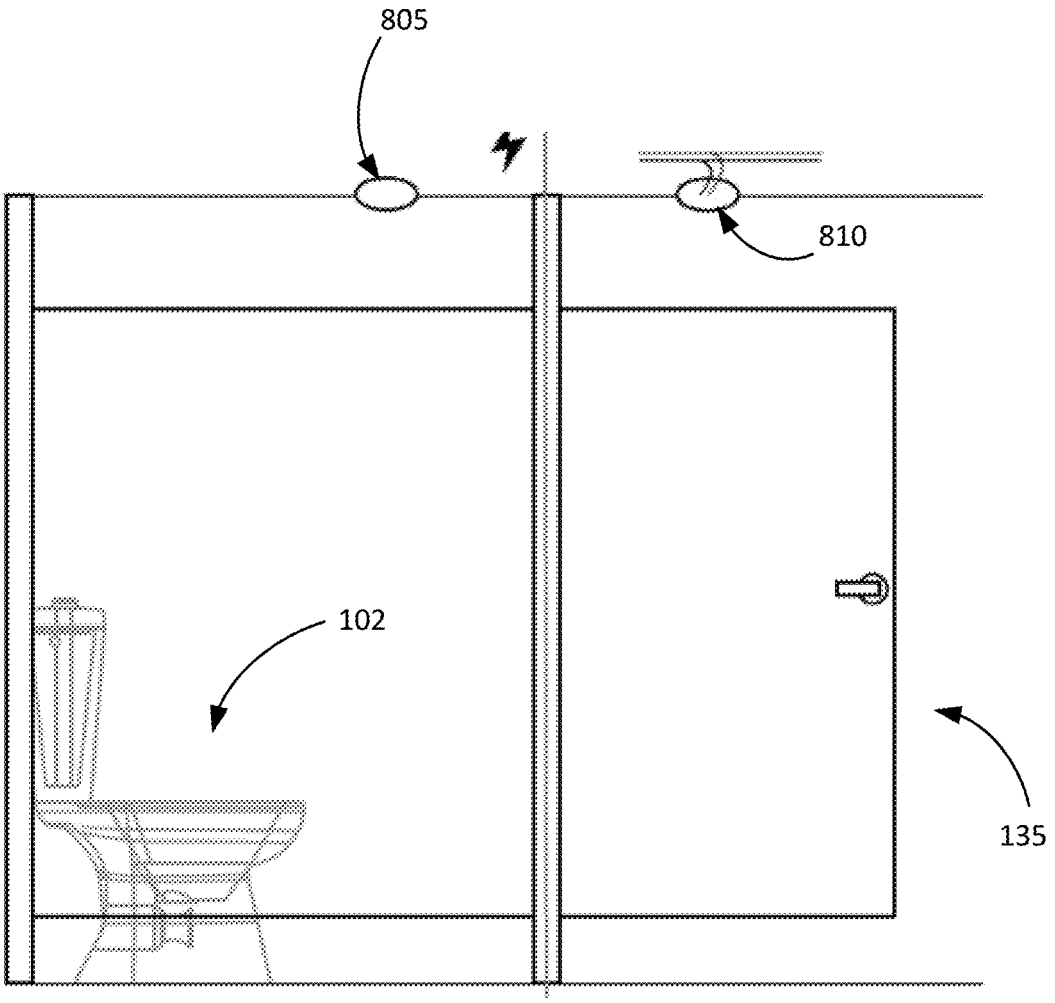
FIG. 8 illustrates a set of placement locations for the availability indicator of FIG. 6 according to some embodiments.

In some embodiments, the availability indicators 115 are positioned in a facility within proximity to a corresponding facility subsystem 135. Accordingly, the availability indicators 115 may be mounted to, for example, a ceiling of the facility, a wall of the facility, a fixture 102 of the corresponding facility subsystem 135, an end point device 102 of the corresponding facility subsystem 135, or another surface or device associated with the corresponding facility subsystem 135. As one example, FIG. 7 illustrates a set of availability indicators 115 mounted to a ceiling of a facility. In the illustrated example, the availability indicators 115 are mounted such that each of the availability indicators 115 are outside a corresponding facility subsystem 135 (depicted as restroom stalls in FIG. 7). Alternatively or in addition, in some embodiments, the availability indicators 115 may be mounted inside a corresponding facility subsystem 135, as illustrated in FIG. 8. FIG. 8 illustrates a set of placement locations for the availability indicators 115 according to some embodiments. As seen in FIG. 8, an availability indicator 115 may be positioned at a first placement location 805 located within the restroom stall (for example, the facility subsystem 135). Alternatively or in addition, an availability indicator 115 may be positioned at a second placement location 810 located outside the restroom stall (for example, the facility subsystem 135).

Returning to FIG. 1, the user device 120 and the server 125 are computing devices, such as a desktop computer, a laptop computer, a tablet computer, a terminal, a smart telephone, a smart television, a smart wearable, or another suitable computing device that interfaces with a user. Although not illustrated in FIG. 1, the user device 120 and the server 125 may include similar components as the end point device 105, such as an electronic processor (for example, a microprocessor, an ASIC, or another suitable electronic device), a memory (for example, a non-transitory, computer-readable storage medium), a communication interface, such as a transceiver, for communicating over the communication network 140 and, optionally, one or more additional communication networks or connections, and one or more human machine interfaces.

In some embodiments, the server 125 may include multiple electronic processors, multiple memory modules, multiple communication interfaces, or a combination thereof. Also, it should be understood that the functionality described herein as being performed by the server 125 may be performed in a distributed nature by a plurality of computers located in various geographic locations. For example, the functionality described herein as being performed by the server 125 may be performed by a plurality of computers included in a cloud computing environment.

The server 125 is configured to monitor and manage one or more facilities, including the fixtures 102 therein. In some embodiments, the server 125 (via an electronic processor of the server 125) may receive fixture data, availability data, or a combination thereof from the facility device 110. In response to receiving the fixture data, availability data, or a combination thereof, the server 115 may process the fixture data, availability data, or a combination thereof in order to determine usage information or patterns associated with the one or more facilities, including the fixtures 102 thereof. The server 125 may store the usage information or patterns in, for example, a memory of the server 125. Alternatively or in addition, the server 125 may transmit the usage information or patterns to a remote device for storage.

A user may interact with and access data associated with one or more facilities, such as one or more of the fixtures 102 therein (for example, the usage information or patterns determined by the server 125). The user device 120 may be used by an end user, such as a facility entity, to monitor and manage a facility, one or more fixtures 102 of a facility, or a combination thereof. For example, a user may access and interact with the data determined by the server 125 to view and understand usage patterns, which may allow a facility entity or maintainer insights into, for example, how to optimize cleaning and maintenance schedules, whether there is a need for additional facilities, end point devices, or a combination thereof. For example, to communicate with the server 125 (i.e., the usage information or patterns determined by the server 125), the user device 120 may store a browser application or a dedicated software application executable by an electronic processor for interacting with the server 125.

Figure 9:
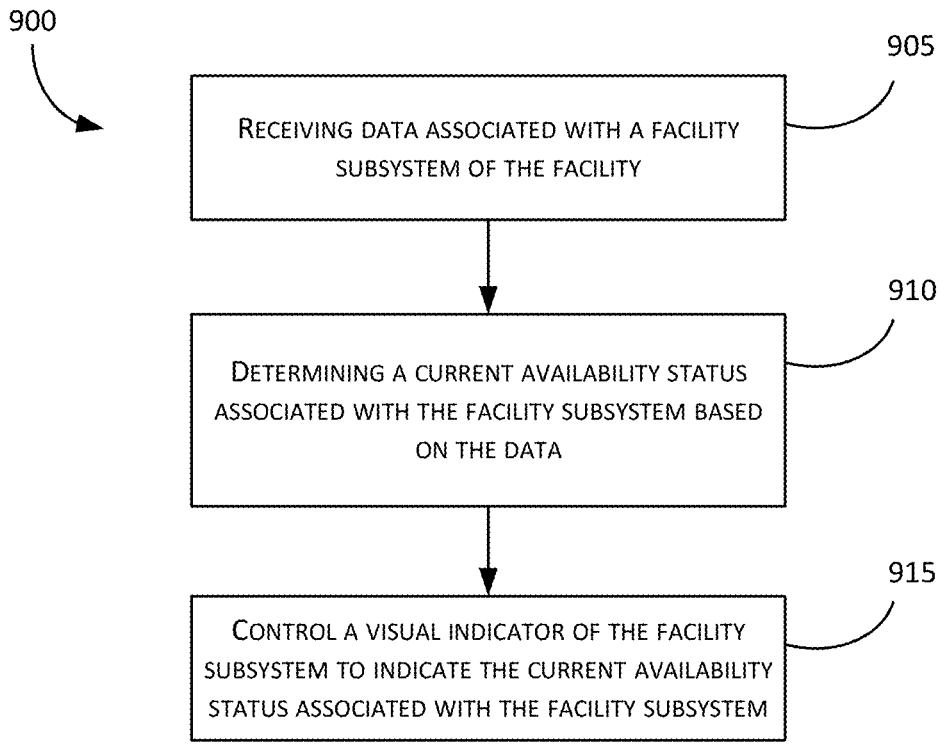
FIG. 9 is a flowchart illustrating a method of providing an availability status associated with a facility using the system of FIG. 1 according to some embodiments.
Figure 10:
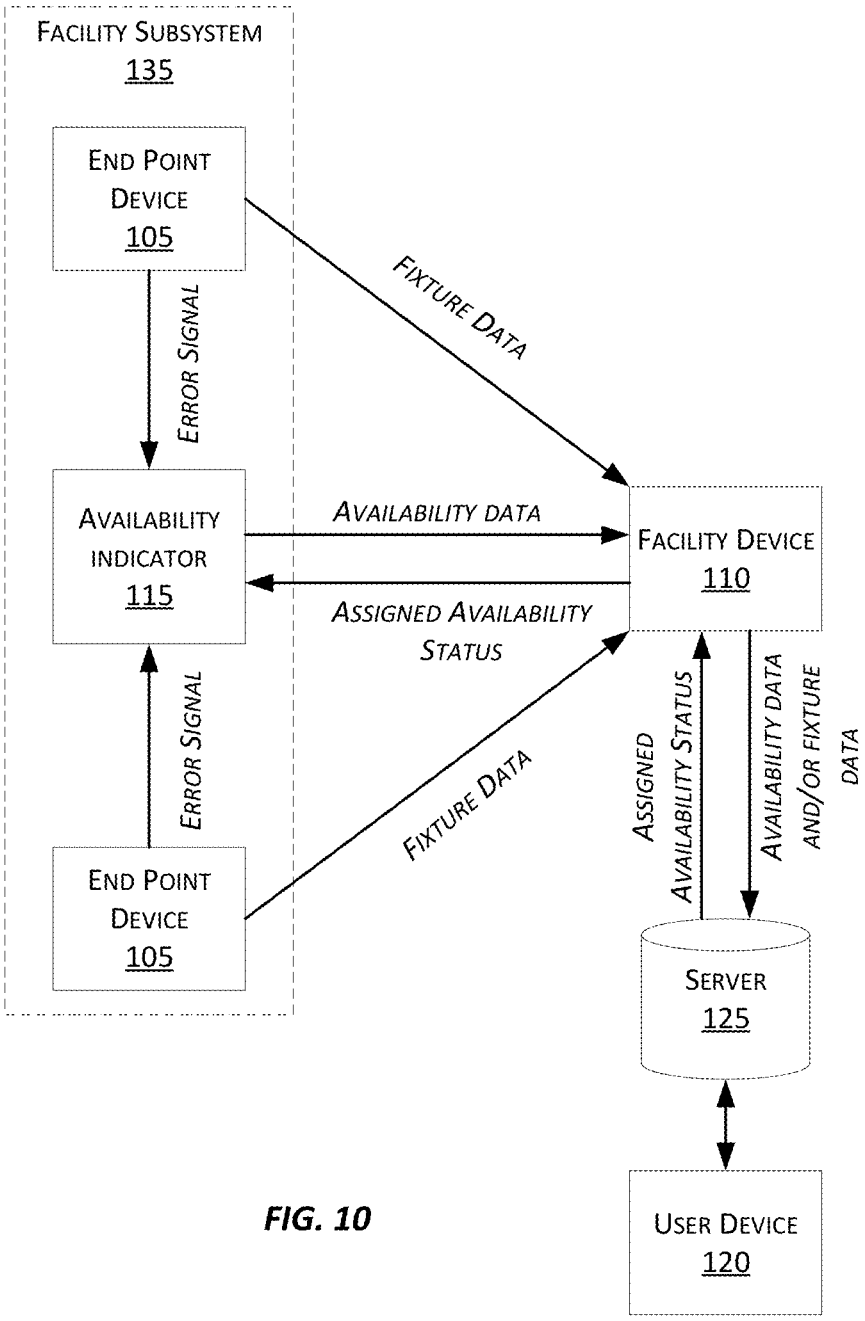
FIG. 10 illustrates example communication between components of the system of FIG. 1 according to some embodiments.

FIG. 9 is a flowchart illustrating a method 900 of providing an availability status associated with a facility according to some embodiments. The method 1100 is described herein as being performed by the availability indicator 115 (the controller 600 via an electronic processor executing instructions). However, as noted above, the functionality performed by the availability indicator 115 (or a portion thereof) may be performed by other devices, such as one or more components of the system 100. The method 900 is described herein with reference to FIG. 10. FIG. 10 illustrates communication between components of the system 100 according to some embodiments.

As seen in FIG. 9, the method 900 includes receiving, with the controller 600, data associated with the facility subsystem 135 of a facility (at block 905). In some embodiments, the controller 900 receives the data from the indicator sensor 615. Accordingly, in such embodiments, the controller 900 receives data related to whether the facility subsystem 135 is available (for example, whether the facility subsystem 135 is currently being used by a user). Alternatively or in addition, in some embodiments, the controller 900 receives data from one or more of the end point devices 105 associated with the facility subsystem 135. As seen in FIG. 10, in such embodiments, the availability indicator 115 (for example, the controller 900) may receive an error signal from an end point device 105 associated with the facility subsystem 135. As noted above, an error signal may indicate that a fixture 102 associated with the facility subsystem 135 is malfunctioning or experiencing a fault/error condition (for example, a run-on condition). Alternatively or in addition, in some embodiments, the controller 900 receives data from a remote device. As seen in FIG. 10., in such embodiments, the controller 900 may receive an assigned availability status for the facility subsystem 135. The assigned availability status for the facility subsystem 135 may be assigned or set by, for example, a user interacting with the facility device 110, the user device 120, the server 125, another component of the system 100, or a combination thereof. As noted above, an assigned availability status may be set by a user as part of a maintenance schedule or protocol. As one example, a user (via the facility device 110 or the user device 120) set an availability status for a fixture 102 as unavailable when that fixture 102 is due for maintenance.

After receiving the data (at block 905), the controller 900 determines a current availability status for the facility subsystem 135 based on the data (at block 910). The current availability status indicates whether the facility subsystem 135 (or a fixture 102 thereof) is available for use by a user. In some embodiments, the controller 900 determines the current availability status for the facility subsystem 135 based on data received from the indicator sensor 615. Accordingly, in such embodiments, the controller 900 determines the current availability status for the facility subsystem 135 based on whether or not the data received from the indicator sensor 615 indicates that the facility subsystem 135 (or a fixture 102 thereof), is currently being used by a user. As one example, when a fixture 102 of the facility subsystem 135 is currently being used by a user, the facility subsystem 135 may be unavailable for use by another user. According to this example, the controller 900 may determine the availability status of the facility subsystem 135 as unavailable. As another example, when the fixture 102 of the facility subsystem 135 is not currently being used by a user, the facility subsystem 135 may be available for use. According to this example, the controller 900 may determine the availability status of the facility subsystem 135 as available.

Alternatively or in addition, in some embodiments, the controller 600 determines the current availability status based on data received (via indicator communication interface 610) from one or more end point devices 105 (for example, an end point device 105 included in the facility subsystem 135). In some embodiments, the data received from the end point device 105 may be an error signal indicating a malfunction or error of a fixture 102 associated with the end point device 105 (as illustrated in FIG. 10). As one example, when a flush valve (as the fixture 102) experiences a run-on condition, the controller 600 may receive an error signal and determine that the current availability status for the facility subsystem 105 associated with the flush valve is unavailable due to the run-on condition. Accordingly, in such embodiments, the controller 900 determines the current availability status for the facility subsystem 135 based on whether or not each fixture 102 of the facility subsystem 135 is experiencing a malfunction.

Alternatively or in addition, in some embodiments, the controller 600 determines the current availability status based on data (for example, a control signal or an assigned availability status) from a remote device (for example, the facility device 110, the user device 120, or another component of the system 100). As one example, when the facility subsystem 135 is due for maintenance, a user may manually set the availability for the facility subsystem 135 to unavailable. According to this example, the controller 600 may receive the assigned availability status as unavailable for the facility subsystem 135 and determine the current availability status for the facility subsystem 135 as unavailable.

After determining the current availability status (at block 910), the controller 600 controls the visual indicator 615 associated with the facility subsystem 135 to indicate the current availability status for the facility subsystem 135 (at block 915). As noted above, the controller 600 may control the visual indicator 605 by generating and transmitting one or more control signals to the visual indicator 605 based on the current availability status. The visual indicator 605 may indicate the current availability status by visually displaying (or illuminating) various colored lights as an indication of the current availability status. Accordingly, in some embodiments, the controller 600 controls the visual indicator 615 to display one or more specific colors based on the current availability status. The controller 600 may control the visual indicator 615 to display a first color when the current availability status is unavailable and a second color when the current availability status is available, where the first color is different from the second color. As one example, the visual indicator 605 may display a red light to indicate the availability status of "available." As another example, the visual indicator 605 may display a green light to indicate the availability status of "unavailable." Alternatively or in addition, in some embodiments, the controller 600 controls the visual indicator 615 to flash or otherwise display one or more specific colors based on the current availability status. As one example, when the facility subsystem 135 is experiencing an emergency error (for example, a flooding condition), the visual indicator 615 may flash a red color.

In some embodiments, the controller 600 transmits availability data associated with the facility subsystem 135 to a remote device, such as, for example, the facility device 110, the user device 120, the server 125, or the like. The availability data transmitted to the remote device may include, for example, the data received by the controller 600 (at block 905) the current availability status determined by the controller 600 (at block 910), or a combination thereof.

Accordingly, in some embodiments, the controller 600 transmits the availability data for virtual or remote processing. The controller 600 may transmit the data to the facility device 110 (as a gateway device). For example, as illustrated in FIG. 10, the availability indicator 115 (for example, the controller 600) transmits the availability data to the facility device 110. The facility device 110 may then forward the availability data to a remote device, server, or database for virtual processing in the cloud, such as, for example, the user device 120, the server 124, or a combination thereof (as seen in FIG. 10). As one example, a user may use the user device 120 (or another remote device) to access and interact with the data. The user may view and interact with usage patterns, which may allow a facility entity or maintainer insights into, for example, how to optimize cleaning and maintenance schedules (for example, for preventative or predicted maintenance), whether there is a need for additional facilities, facility subsystems 135, or a combination thereof, and the like. As noted above, in some embodiments, the server 125 is configured to monitoring and managing one or more facilities, including the fixtures 102 or facility subsystems 135 therein. In some embodiments, the server 125 (via an electronic processor of the server 125) may receive availability data, fixture data, or a combination thereof from the facility device 110 (as seen in FIG. 10). In response to receiving the availability data, the fixture data, or a combination thereof, the server 125 may process the received data in order to determine usage information or patterns associated with the one or more facilities, including the facility subsystems 135 and/or fixtures 102 thereof.

Thus, the embodiments provide, among other things, methods and systems for determining an availability of a facility, a facility subsystem including one or more end point devices, or a combination thereof, and, more particularly, to providing an availability status associated with the facility via a cloud-connected visual occupancy light or status indicator. Various features and advantages of certain embodiments are set forth in the following claims.

What is claimed is:

1. A facility subsystem comprising:

a visual indicator;

at least one fixture;

a plurality of sensors configured to detect operational data associated with the facility subsystem and comprising an operational status of the at least one fixture and an occupancy status of the facility subsystem; and a controller communicatively coupled to the visual indicator and the sensors, the controller configured to:

receive the operational data from the sensors, determine a current availability status for the facility subsystem based on the operational data received from the sensors, wherein the current availability status is determined as unavailable when the operational status of the fixture indicates a malfunction or the occupancy status indicates an occupancy of the facility subsystem, provide a control signal to the visual indicator to indicate the current availability status associated with the facility subsystem, and receive an assigned availability status associated with the facility subsystem from a remote device, wherein the assigned availability status is set by a user.

2. The system of claim 1, wherein the controller is further configured to transmit availability data associated with the facility subsystem to a remote device.

3. The system of claim 2, wherein the availability data includes at least one selected from a group consisting of the current availability status and the operational data received from the sensor.

4. The system of claim 1, wherein the sensor is a thermal sensor.

5. The system of claim 1, wherein the controller is configured to control the visual indicator to display a first color when the current availability status is unavailable and a second color when the current availability status is available, wherein the first color is different from the second color.

6. The system of claim 1, wherein the controller is configured to determine the current availability status associated with the facility subsystem as the assigned availability status.

7. The system of claim 1, wherein the facility subsystem is a restroom stall.

8. The system of claim 1, wherein the fixture is a toilet positioned within the facility subsystem.

9. The system of claim 1, wherein the fixture is a resource dispenser positioned within the facility subsystem.

10. The system of claim 1, wherein the malfunction indicates a run-on condition associated with the fixture.

11. A method for providing an availability status associated with a facility subsystem, the method comprising:

receiving, from a plurality of sensors, operational data associated with the facility subsystem and comprising an operational status of at least one fixture associated with the facility subsystem and an occupancy status of the facility subsystem;

determining, with an electronic processor, a current availability status for the facility subsystem based on the operational data, wherein the current availability status is determined as unavailable when the operational status of the fixture indicates a malfunction or the occupancy status indicates an occupancy of the facility subsystem; and providing, with the electronic processor, a control signal to a visual indicator of the facility subsystem to indicate the current availability status associated with the facility subsystem, wherein receiving the data associated with the facility subsystem includes receiving an assigned availability status from a remote device, the assigned availability status set by a user.

12. The method of claim 11, wherein determining the current availability status associated with the facility subsystem includes determining the current availability status as the assigned availability status.

* * * * *